US005313134A

United States Patent [19]

Borgis et al.

[11] Patent Number: 5,313,134

[45] Date of Patent: May 17, 1994

[54] CAPPED ELECTRIC LAMP FOR OPERATION AT MAINS VOLTAGE AND LAMP CAP UNIT FOR USE THEREIN

[75] Inventors: Livio Borgis, S. Antonio di Susa; Marco V. P. Piacibello, Turin, both of Italy

[73] Assignee: U.S. Philips Corporation, New York, N.Y.

[21] Appl. No.: 834,074

[22] Filed: Feb. 11, 1992

[30] Foreign Application Priority Data

Feb. 28, 1991 [NL] Netherlands ..... 9100369
Aug. 22, 1991 [EP] European Pat. Off. ..... 91202148

[51] Int. Cl.[5] ..... H01J 5/48; H01J 5/50

[52] U.S. Cl. ..... 313/318; 439/611; 439/616

[58] Field of Search ..... 313/318; 439/611, 616, 439/617, 619

[56] References Cited

U.S. PATENT DOCUMENTS 2,730,689 12/1951 Lamb et al. ..... 439/747
4,570,104 2/1986 Janssen et al. ..... 313/318

FOREIGN PATENT DOCUMENTS 0677964 8/1952 United Kingdom ..... 313/318
0678498 9/1952 United Kingdom ..... 313/318
2120842A 12/1983 United Kingdom ..... 313/318

*Primary Examiner*—Donald J. Yusko
*Assistant Examiner*—Nimesh Patel
*Attorney, Agent, or Firm*—Robert J. Kraus

[57] ABSTRACT

A capped electric lamp for use at mains voltage includes a lamp vessel (1), a lamp cap (10) and a mounting member (40). The lamp cap has a shell (20) and an insulator body (30), the shell being secured to the lamp vessel by an adhesive compound. The insulator body is secured to the shell. Current supply conductors (6) extend from the lamp vessel and through the insulator body, and where they emerge therefrom are connected to contact pins (31) which are anchored in the insulator body. The contact pins extend through the mounting member (40) and are secured in cavities (32) in the insulator body. The mounting member may have various different shapes, e.g., it may be composed of two parts, one of which is rotatably supported in the other. Such a lamp construction is reliable and easily manufactured.

17 Claims, 9 Drawing Sheets

CAPPED ELECTRIC LAMP FOR OPERATION AT MAINS VOLTAGE AND LAMP CAP UNIT FOR USE THEREIN

BACKGROUND OF THE INVENTION

1. Field of the Invention

The invention relates to a capped electric lamp for operation at mains voltage, comprising:

a lamp vessel which is vacuum sealed and has an end portion which is fused to a stem tube which projects into the lamp vessel and surrounds an exhaust tube;

an electric element in the lamp vessel connected to current supply conductors which extend to the exterior alongside the exhaust tube;

a lamp cap provided with a shell having an axis, a first end of the shell being fixed around the said end portion of the lamp vessel with an adhesive compound, and a second end of the shell being coupled to an insulator body;

contact pins fixed in the insulator body and extending to the exterior therefrom for connection to respective current supply conductors.

The invention also relates lamp cap unit suitable for use in the lamp according to the invention.

A lamp of the kind described in the opening paragraph and suitable for operation at low power is known from U.S. Pat. No. 2,730,689, issued Jan. 10, 1956. Such lamp has the disadvantage that a lampholder is required for mounting the lamp against a surface, for example against a wall of an electric appliance such as, a refrigerator or a microwave oven. Moreover, the lamp provides no points of application for positive retention by a lampholder. It can be held only by its contact pins.

Another disadvantage of the known lamp is that the current supply conductors must be passed between the legs of respective contact pins, which each consist of a metal strip curved in a hairpin shape, during assembly of the lamp vessel with the lamp cap. Then, the lamp cap must be affixed around the lamp vessel. During this assembly, the current supply conductors must pass on further between the legs of the contact pins of their own accord. If they do not, there is a great risk of short-circuiting inside the lamp cap. Subsequently, the contact pins are flattened, by which contact with the current supply conductors is to be achieved. Such a contact is unreliable in the event of corrosion of the supply conductors and/or the contact pins.

SUMMARY OF THE INVENTION

It is an object of the invention to provide a lamp of the kind described above, as well as a lamp cap unit for use therein, which inter alia avoids the necessity of using a lampholder and renders it possible to achieve a positive retention of the lamp, and which is also of reliable construction which can be easily manufactured.

This object is achieved in that the current supply conductors extend outside the insulator body and are there connected to the respective contact pins, and in that a mounting member made of synthetic resin is connected to the insulator body, from which mounting member only the contact pins project to the exterior.

In the lamp according to the invention, the connection between the current supply conductors and the contact pins is made outside the insulator body. This may be done after the lamp cap has been affixed around the lamp vessel. The connection may be effected, for example, by welding or soldering the conductor laterally against the contact pins. The connection may be inspected for its correctness and the current supply conductors may be drawn taut beforehand, so that an excess length thereof inside the lamp cap can be avoided. The mounting member renders possible a positive retention of the lamp on the surface which is to support the lamp, for example a wall of an appliance, while nevertheless a lampholder is dispensed with. The lamp may be electrically supplied via a connector present on a cable which the connector being connected to an electrical supply is applied to the contact pins.

It is favourable if the mounting member has a projecting sheath from which the contact pins extend to the exterior, or a separate sheath for each contact pin. It can be assured in this way that the contact pins do not touch the surface on which the lamp is mounted and that no electrical contact is made with this surface if the latter is of metal.

It is favourable if the contact pins have a widened portion which is to butt against a surface of the mounting member facing towards the insulator body. This provides the safeguard that the lamp will retain the contact pins, even if a pulling force is exerted on them. Such pulling forces can be exerted on the contact pins when a connector is removed from the lamp. If a lamp should lose its grip on a contact pin during this, this pin would have to be removed from the connector while this pin could still be under electrical tension.

In the lamp according to the cited U.S. Pat. No. 2,730,689, the contact pins are inserted in the insulator body from the outside and fixed therein by flattening. There is a risk, however, of the lamp losing its grip on the pins when the lamp is forced from a holder.

In a favourable embodiment of the present invention that is prevented in that the insulator body is made of synthetic resin and has cavities in the surface thereof remote from the lamp vessel, in which cavities the respective contact pins are anchored. Each contact pin may be provided with, for example, barbed hooks or teeth with which it has fixed itself in the cavity. It is favourable that the lamp cap in this embodiment can be easily assembled with its contact pins by inserting the contact pins in the insulator body until they abut. The contact pins are securely held by the insulator body during the application of a connector, whereas during removal of the connector the simultaneous removal of a contact pin is blocked by the mounting member.

The mounting member may have a flange-shaped portion with holes through which the lamp can be fixed against a wall with screws, or with resilient pins, so that the lamp may be fixed with these pins in holes in a wall.

Favourable are embodiments in which resilient tongues curved in a hairpin shape project from the mounting member, for example at a flange-shaped portion, which tongues each have a free end with a wedge-shaped thicker portion. The tongues may then extend alongside the axis of the shell to beyond a location where they project from the mounting member.

In these embodiments, the lamp may be inserted in an opening in a wall, either with the lamp cap facing forwards, or with the lamp vessel facing forwards, in order to butt against this wall with the mounting member and to hook behind this wall with the wedge-shaped thicker portions at the tongues. The lamp can thereby be mounted against a wall in a very fast, easy, and reliable manner, and may also be readily removed e.g. in that the tongues are bent.

It is favourable if the mounting member has an upright rim in which the insulator body is accommodated. Such a rim gives the current supply conductors an improved electrical insulation from the surroundings of the lamp and is capable of preventing the penetration of moisture into the interior.

In an embodiment, the insulator body has for each of the current supply conductors a narrowing channel which issues from the insulator body near where a respective contact pin projects to the exterior. The current supply conductors then project to the exterior at an accurately determined location and can thus be easily found by the assembling machine in order to be fastened to the contact pins.

This embodiment renders it possible for the current supply conductors to be fully separated from one another by the adhesive compound, the insulator body and the mounting member at least at the point where they leave the end portion of the lamp vessel. A discharge arc in a current supply conductor, arising through fusion of a fuse wire therein at the end of lamp life is thereby impeded from jumping over to the other conductor. A discharge arc having a relatively long duration is thus avoided.

It is favourable, also to facilitate assembly of the lamp cap, if the insulator body is made of synthetic resin. The mounting member may then be easily fastened to the insulator body, for example with screws. The insulator body may for this purpose have cavities in a plane remote from the shell for accommodating the bodies of screws. It is favourable if the screws are countersunk to below a surface of the mounting member, so it can then be flush mounted against a flat wall.

The shell of the lamp cap may be a metal ring. Such a ring has the advantage that it can be heated to a comparatively high temperature if heating should be necessary for curing the adhesive compound, such as a cement, e.g. a lamp cement, or for effecting adhesion. This can be realized in a comparatively short time.

It is also easy to fasten a metal ring to an insulator body made of synthetic resin. There is no need to form the body in a mould to conform with the ring. Instead, the insulator body may have a collar and the metal ring may have an inwardly flanged rim at its second end which cooperates with said collar.

The metal ring may engage the insulator body with a clamping fit, and means may provided for locking the two parts against mutual rotation. It is favourable for this purpose if the insulator body has projections on the collar which grip into the flanged rim. The rim may have recesses for this purpose, for example if brass or bronze is used, or it may be deformed by said projections, for example if aluminum is used.

A reflector may be readily fastened to the metal ring for concentrating the generated radiation into a beam transverse to the axis or in the direction of the axis. Alternatively, a cover which transmits no or little light may be provided over the lamp vessel so that the lamp can be used exclusively or almost exclusively as a heat source. The cover may be fastened to the lamp vessel or alternatively to the metal ring, for example, with an adhesive agent, such as silicone cement. Such a lamp may be used, for example, as a defroster.

A metal ring, however, is an additional component that must be assembled together with other components. It is accordingly attractive if the shell of the lamp cap, instead of being a metal ring is integral with the insulator body. It is favourable in that case for the shell to consist of synthetic resin, for example polyphenylene sulphide or a liquid-crystalline polymer.

The insulator body may be formed, for example, from synthetic resin in the presence of the contact pins. A very secure anchoring of the contact pins may thus be obtained which guarantees that the insulator body, or the lamp cap, will not lose its grip on the contact pins. It is favourable also in this case for the insulator body to have narrowing channels for the current supply conductors. The contact pins, however, may be inserted into the insulator body from the side facing the lamp vessel so that an anchorage of these pins is ensured also in the case of a pulling force.

The assembly with the mounting member is very convenient if the contact pins each have a recess, for example a hole, and the mounting member has resilient projections which each grip into a respective recess, thus keeping the mounting member fixed, connected to the insulator body. The mounting member is then provided simply by passing it over the contact pins up to an end position in which the projections each enter a corresponding recess.

The lamp according to the invention may be so constructed that it radiates the generated light in a pattern which is not rotationally symmetrical. The electric element, for example an incandescent filament, may be positioned, for example, transverse to the axis. Alternatively, the lamp may have a reflector or a screen at one side of the axis, for example a reflecting, scattering, or selectively light-transmitting coating. It may be desirable for such an optical means to be present in an aligned position relative to the mounting member. The lamp vessel must then be connected to the lamp cap in the correct orientation relative to this element. It is difficult to realize this in a mechanized manufacturing process. It is also possible that the lamp must have one orientation for the optical element in one application, for example in an appliance of a first provenance, but a different orientation in an appliance of a different provenance.

In a favourable embodiment, the mounting member comprises a first part which is fixedly connected to the insulator body and which is rotatably held in a second part, keeping this second part coupled to the first part. A convenient construction is one in which the first part rests against a stop in the second part, which stop faces away from the insulator body. The first part of the mounting member together with the lamp vessel, lamp cap and contact pins, is capable of being rotated in a second part of the mounting member which is fixed in relation to the surroundings.

In an attractive modification of the embodiment last mentioned, the first and the second part of the mounting member have cooperating means which provide several rotational positions with a comparatively high degree of fixation against rotation. The lamp vessel can then be rotated relative to the second part, and thus relative to the surroundings, so as to reach a desired position and be kept fixed in this position. The cooperating means may be formed by mutually engaging ribbed rims or by projections and a ribbed rim. Such a ribbed rim may extend in a plane transverse to the axis, but in a favourable embodiment it lies on the surface of a coaxial cylinder or cone.

BRIEF DESCRIPTION OF THE DRAWINGS

Embodiments lamp cap capped electric lamp according to the invention and of a unit therefor are shown in the drawings, in which.

DESCRIPTION OF THE PREFERRED EMBODIMENTS

Figure 1:
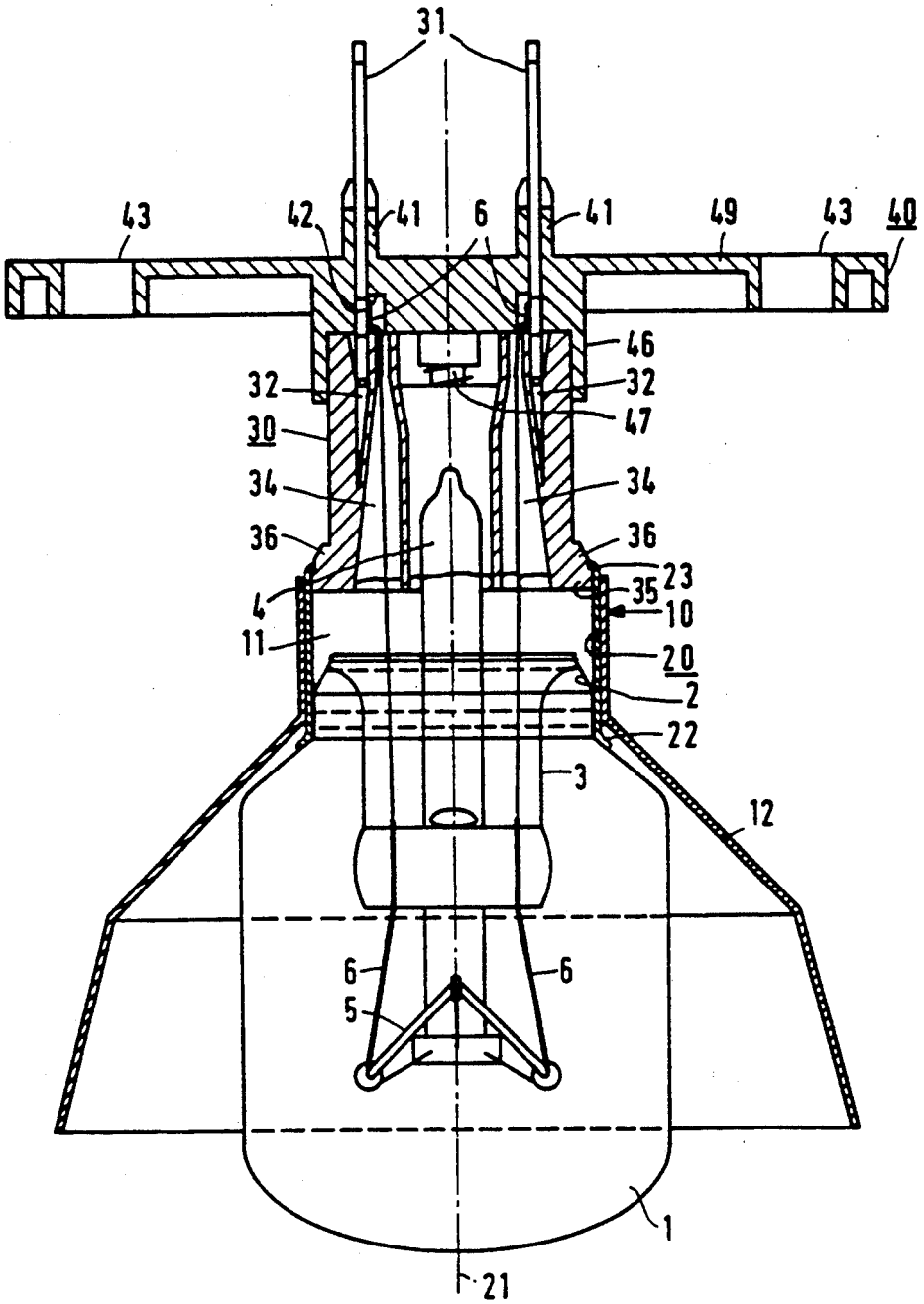
FIG. 1 shows a lamp according to the invention in side elevation with the lamp cap in longitudinal section.

In FIG. 1, the capped electric lamp for operation at mains voltage, for example a 100 W or 25 W/220–230 V lamp, has a lamp vessel 1 which is vacuum sealed and whose end portion 2 is fused to a stem 3 projecting into the lamp vessel and surrounding an exhaust tube 4. An electric element 5, an incandescent filament in the Figure, but alternatively a pair of electrodes, is positioned in the lamp vessel and connected to current supply conductors 6 which extend to the exterior of the vessel alongside the exhaust tube 4.

A lamp cap 10 provided with a shell 20, a metal ring in FIG. 1, having an axis 21, is affixed at a first end 22 thereof around the end portion 2 of the lamp vessel with adhesive compound 11. At a second end 23 thereof the shell is coupled to an insulator body 30. Contact pins 31, which are respectively connected to the respective current supply conductors 6, are fixed in the insulator body 30 and extend therefrom to the exterior.

The current supply conductors 6, where they extend from the insulator body 30, are connected to the respective contact pins 31, laterally in FIG. 1. A mounting member 40 of synthetic resin is connected to the insulator body 30. Only the contact pins 31 extend from this body to the exterior of the lamp.

The mounting number 40 has a projecting sheath 41 for each contact pin 31, so that the pins remain electrically insulated if they are passed through an opening in a metal wall. Holes 43 are present in a flange-shaped portion 49 of the mounting member 40 so that this member may be fastened to a wall with screws. A reflector 12 fastened to the ring 20 concentrates the generated light into a beam which is thrown to the exterior in axial direction.

A widened portion 33 (FIG. 8) of the contact pins 31 butts against a surface 42 of the mounting member 40 facing the insulator body 30.

The mounting member 40 is of synthetic resin, for example polyphenylene sulphide, or, if elasticity is required, polyamide or polyester, and has an upright rim 46 in which the insulator body 30 is accommodated.

The current supply conductors 6 run through respective narrowing channels 34 in the insulator body 30, each channel issuing near a respective contact pin 31 where it extends from the insulator body 30. The said conductors 6 are laterally fastened against the contact pins.

The adhesive compound 11, for example lamp cement, the insulator body 30 and the mounting member 40 completely separate the current supply conductors 6 from one another up from the end portion 2 of the lamp vessel 1.

Figure 7A:
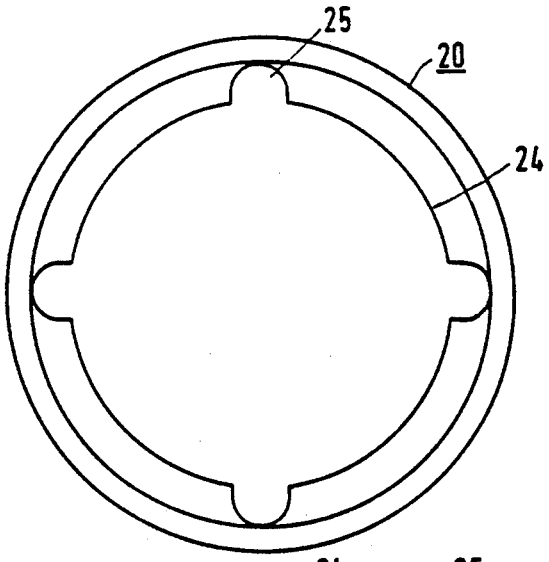
FIGS. 7*a* and *b* show the metal ring of FIGS. 1 to 5 seen away from the lamp vessel and in longitudinal section, respectively.
Figure 7B:
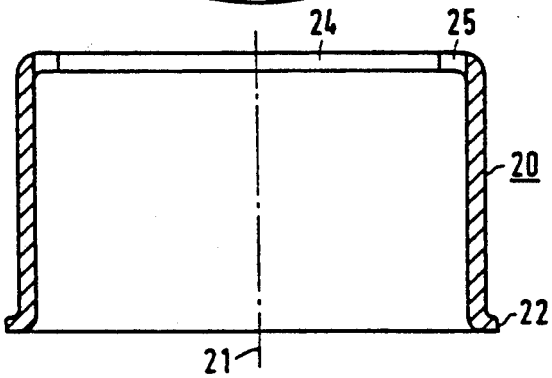

The insulator body 30 is also synthetic resin, for example polyphenylene sulphide, and has a collar 35 which cooperates with an inwardly flanged rim 24 at the second end 23 of the metal ring 20 (see also FIG. 7). The end 23 of ring 20 engages the insulator body 30 with a clamping fit. Projections 36 at the collar 35 of the insulator body 30 constitute means which prevent relative rotation. They grip into the flanged rim 24 of the ring 20.

The contact pins 31 are passed into cavities 32 in the insulator body 30 from outside the mounting member 40, and are anchored in these cavities.

Figure 2:
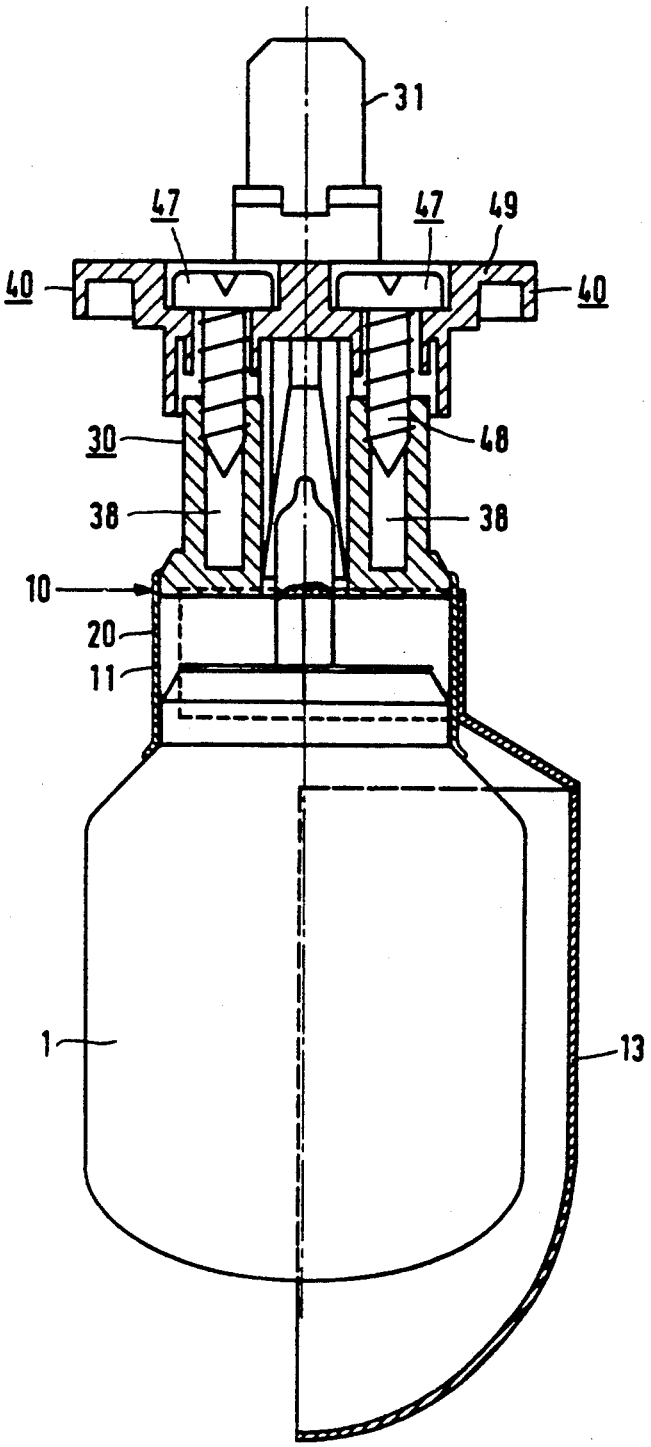
FIG. 2 shows the lamp of FIG. 1 with a different reflector, rotated through 90°.

The lamp of FIG. 2 is identical to the lamp of FIG. 1 except for the reflector 13, which throws the light in transverse direction. The insulator body 30 and the mounting member 40 are fastened to one another with self-tapping screws 47. The insulator body 30 has for this purpose cavities 38 for accommodating the stems 48 of screws 47. The screws 47 are countersunk to below the surface 49 of mounting member 40.

Figure 3:
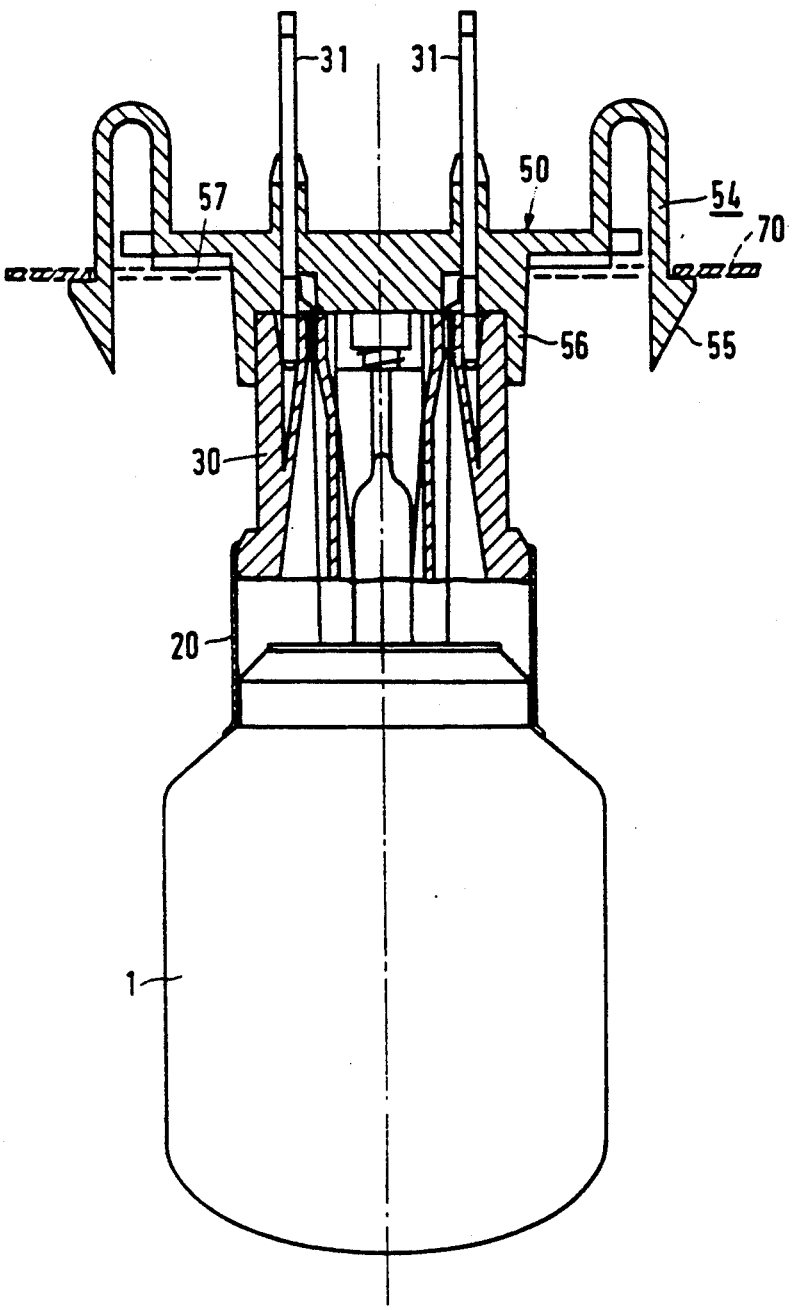
FIG. 3 shows another embodiment of a lamp in accordance with the invention.

In FIG. 3, the mounting member 50 has resilient tongues 54 which are curved in a hairpin shape and which have wedge-shaped thickened portions 55 at their free ends. The tongues extend alongside the axis 21 of the shell 20 to beyond the location where they are present at the mounting member 50. The lamp may be inserted through an opening in a wall 70 with the lamp vessel 1 facing forwards into the wall, the thickened portions 55 passing this wall while being pressed inwards and the surface 57 being checked against this wall. When the thickened portions 55 have passed the said wall, they spring back and engage the wall in conjunction with the surface 57.

Figure 4:
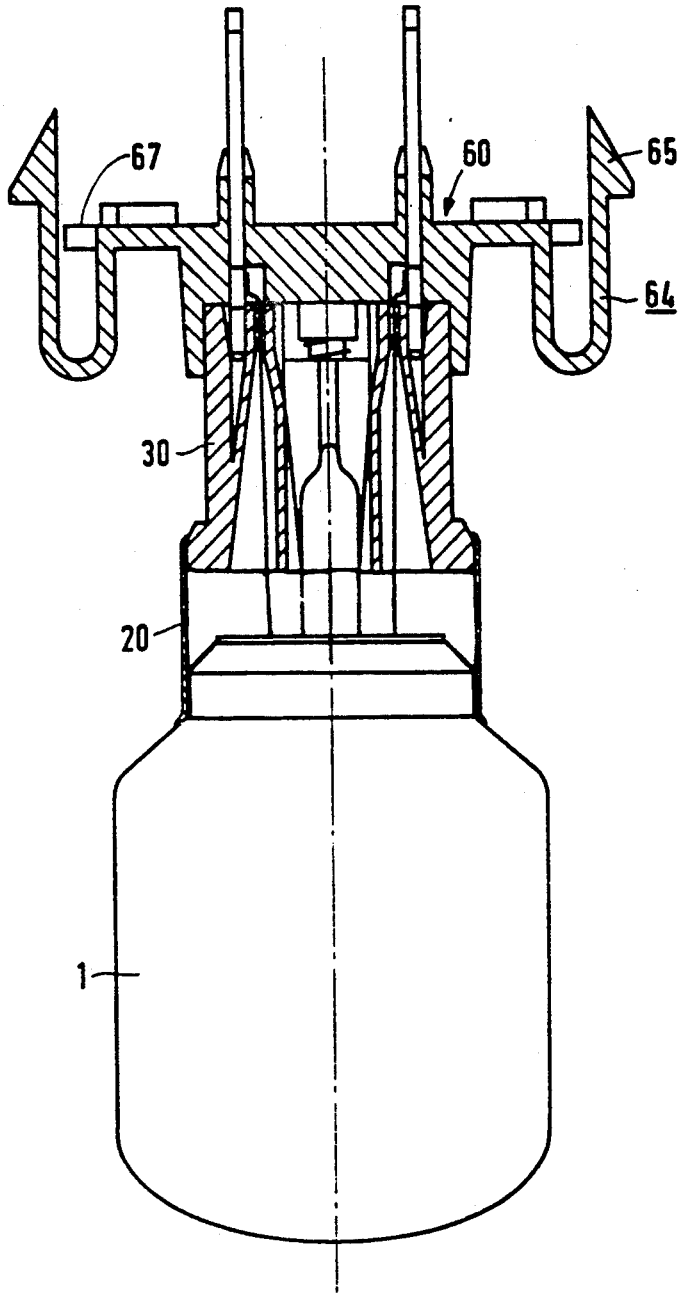
FIG. 4 shows a still further embodiment of a lamp in accordance with the invention.

In FIG. 4, the tongues 64 are oppositely directed to the tongues 54 of FIG. 3. The lamp can be inserted in a wall with the lamp cap 20, 30 facing forwards into the wall.

Figure 5:
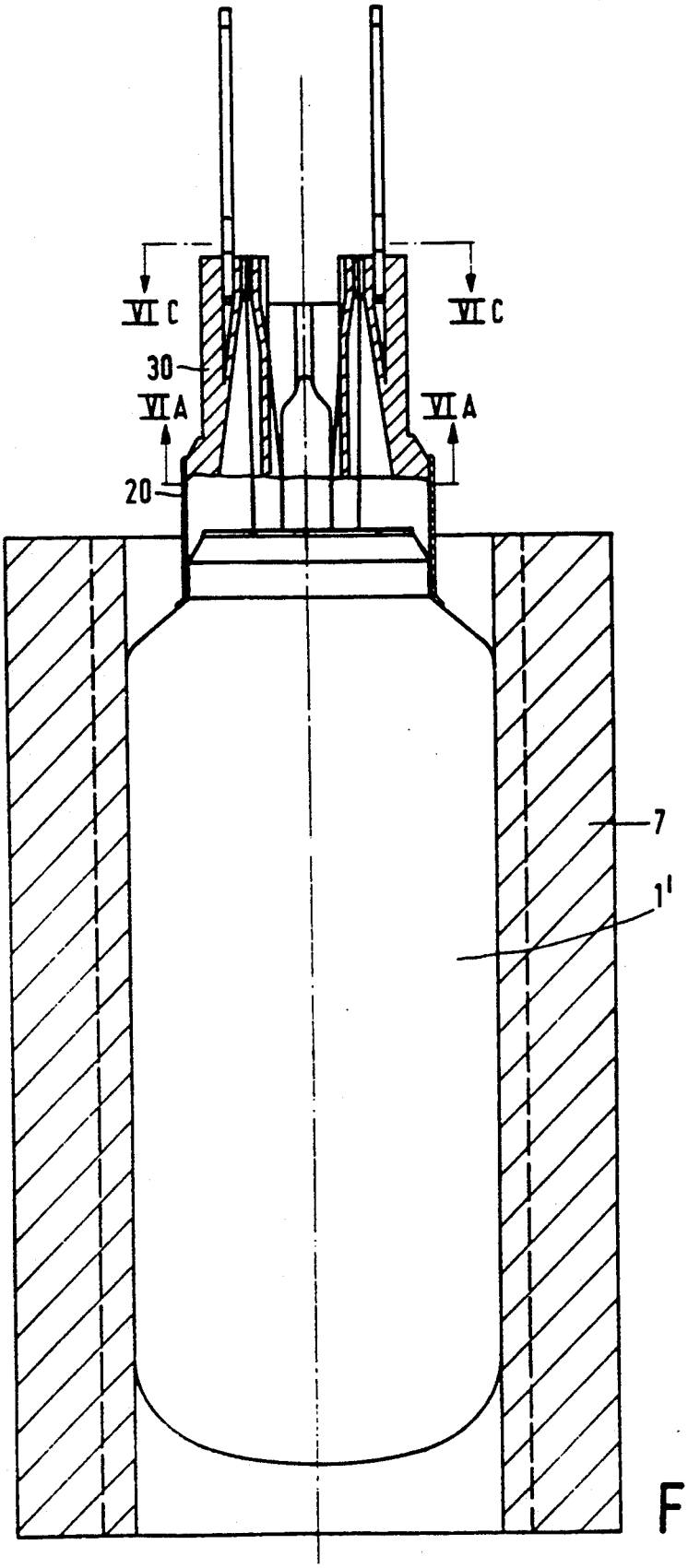
FIG. 5 shows a lamp cap unit for a modification of the lamp in FIG. 1.

The lamp cap unit of FIG. 5 has the insulator body 30 and the metal ring 20 according to the preceding Figures. The lamp vessel 1' is elongate and carries a metal shell 7 which has a ribbed surface. Such lamp may be used as a heat radiator.

Figure 6A:
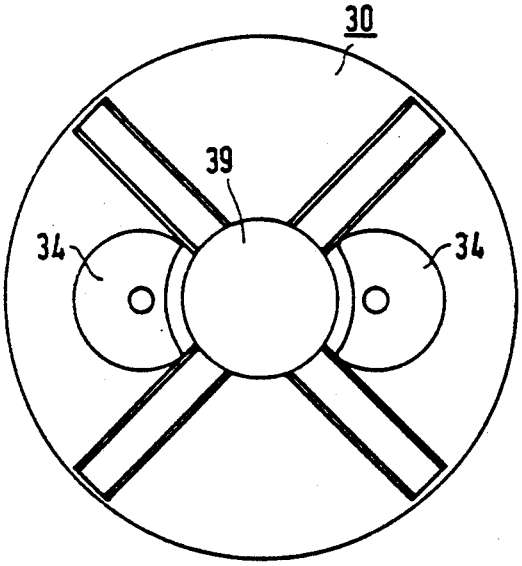
FIGS. 6*a, b, c* show the insulator body of the preceding Figures seen according to VIa, in longitudinal section, and according to VIc in FIG. 5, respectively.
Figure 6B:
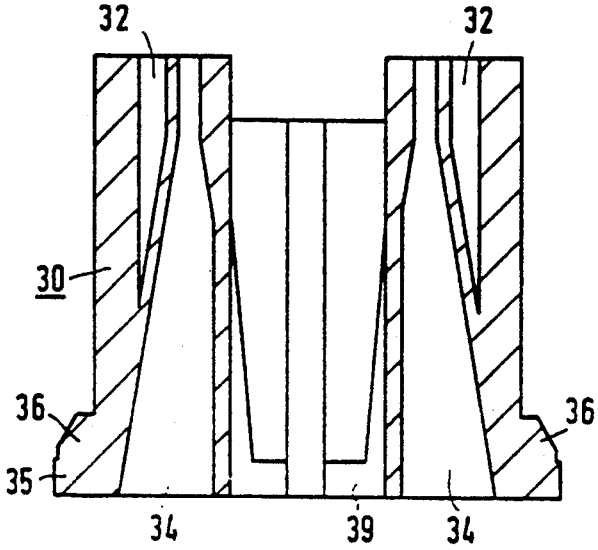
Figure 6C:
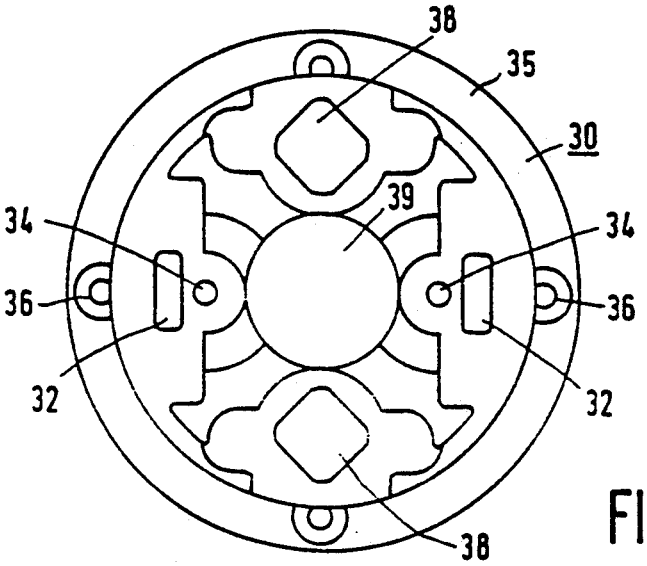

The insulator body 30 of FIGS. 6*a* to 6*c* has a cavity 39 for accommodating the exhaust tube of a lamp vessel. FIG. 6*c* shows that the channels 34 for the current supply conductors issue close to a cavity 36 for each of the contact pins.

The metal ring 20 of FIGS. *7a*, *7b* has recesses 25 in its inwardly flanged rim 24 at on its second end 23, which recesses can cooperate with projections at an insulator body so as to prevent mutual rotation.

Figure 8:
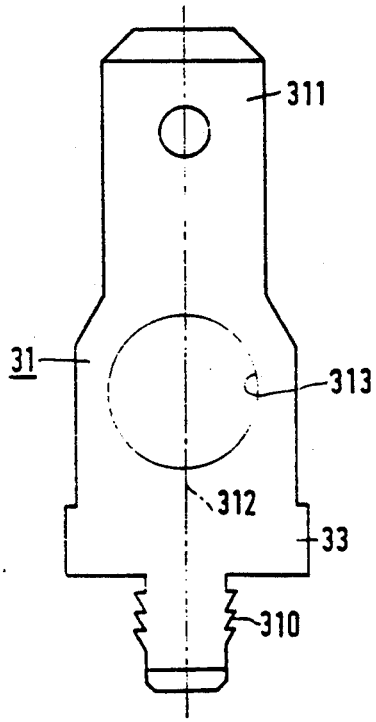
FIG. 8 shows a contact pin in side elevation.
Figure 9A:
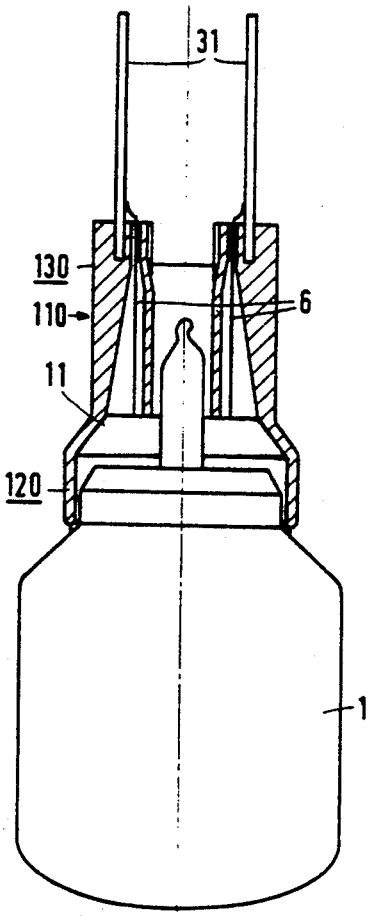
FIG. 9*a* shows a modification of FIG. 5 in side elevation with the lamp cap in longitudinal section, FIGS. 9*b, c, d* showing a mounting member suitable therefor in longitudinal section, in side elevation partly in longitudinal section rotated through 90°, and in elevation seen along the line IXd in FIG. 9*b*.
Figure 9B:
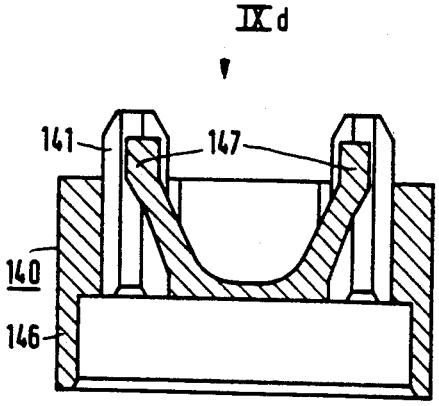
Figure 9C:
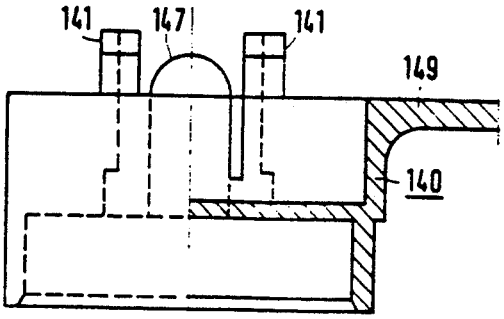
Figure 9D:
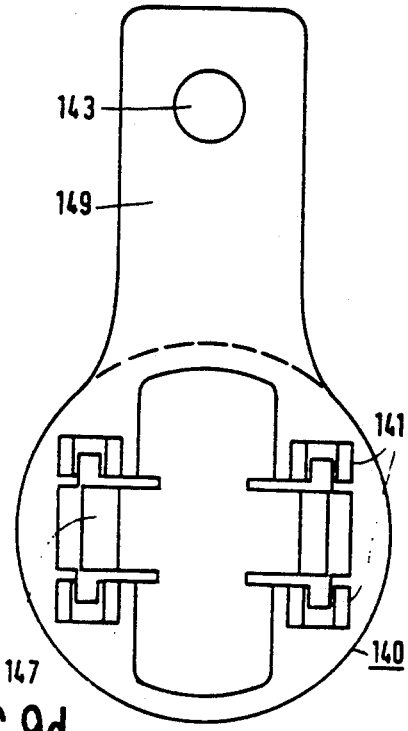

The contact pin 31 of FIG. 8 has a widened portion 33 which is to butt against a mounting member. The pin has a narrow portion with teeth 310 for fixing itself in a cavity of an insulator body. The widened portion 33 may butt against the insulator body in that case. When a connector is applied over a contact portion 311, the widened portion 33 offers resistance to shifting of the contact pin. When the connector is removed, the teeth 310 prevent the insulator body being pulled loose. The widened portion 33 safeguards this by butting against the mounting member. A current supply conductor can be laterally fastened to the pin at 312. The contact pin 31 has a recess 313 which is of importance for the embodiments of FIGS. 9 and 10.

The lamp and the lamp cap unit according to the invention can be readily manufactured. In the embodiments described, the contact pins can be inserted into the insulator body and the metal ring can be slipped over the insulator body so as to be coupled thereto and form a lamp cap. An adhesive compound is provided in the metal ring and the lamp cap is passed towards a lamp vessel whose current supply conductors slide through the narrowing channels and arrive outside the insulator body, while the metal ring surrounds the end portion of the lamp vessel. The adhesion of the compound to the ring and to the lamp vessel is subsequently effected, as is the fastening of the current supply conductors to the contact pins. The unit is then ready. A chosen mounting member may then be slipped over the contact pins towards the insulator body and be fastened thereto in order to obtain a complete lamp.

In FIG. *9a*, the lamp vessel 1 with its contents is identical to that of FIG. 1. Fastened to the lamp vessel there is a lamp cap 110 whose shell 120 and insulator body 130 are integral and consist of, for example, polyphenylene sulphide. The contact pins 31 are present during the formation of the lamp cap and are embedded therein. The unit of FIG. *9a* may be provided with a mounting member 140 as shown in FIGS. *9b*, *c*, and *d*. Parts thereof corresponding to parts in FIG. 1 have reference numerals which are 100 higher. Resilient projections can grip into the recesses 313 of the contact pins (see FIG. 8) and thus connect the mounting member 140 to the insulator body 130, anchoring the former to the latter. This is effected in that the mounting member is simply passed over the contact pins.

In FIG. 10, parts corresponding to those of FIG. 9 have the same reference numerals. The lamp vessel has a mirroring coating 113 at one side of a plane through the axis 121 so that the lamp radiates light mainly in a lateral direction.

Figure 10A:
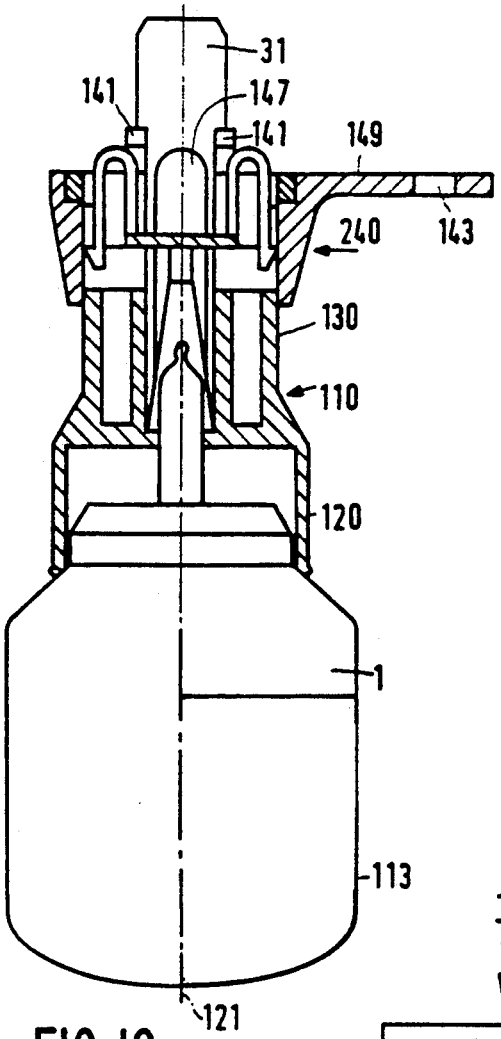
FIG. 10*a* shows a further embodiment with a lamp cap in longitudinal section, the first part of the mounting member being in side elevation and in cross-section in FIGS. 10*b* and *c*, the second part being in cross-section and in elevation in FIGS. 10*d* and *e*, respectively.
Figure 10B:
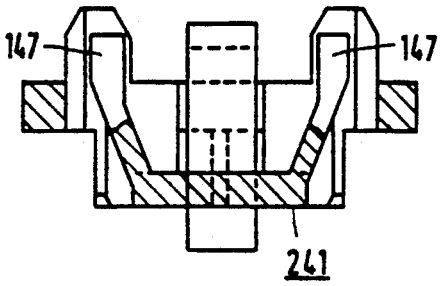
Figure 10C:
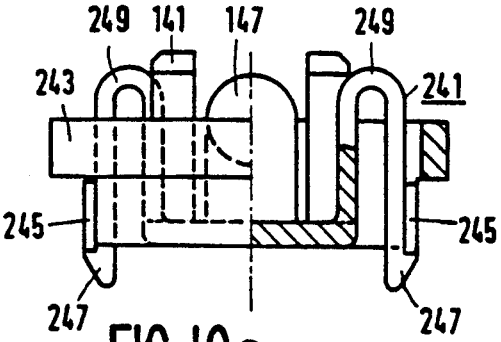
Figure 10D:
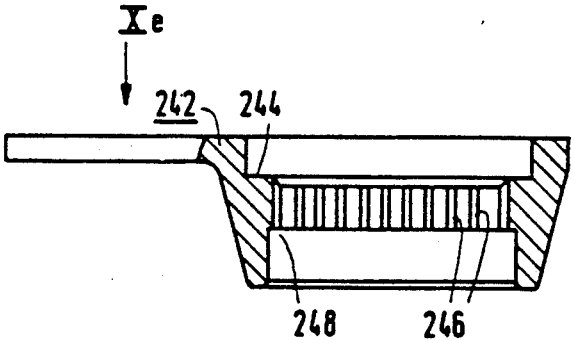
Figure 10E:
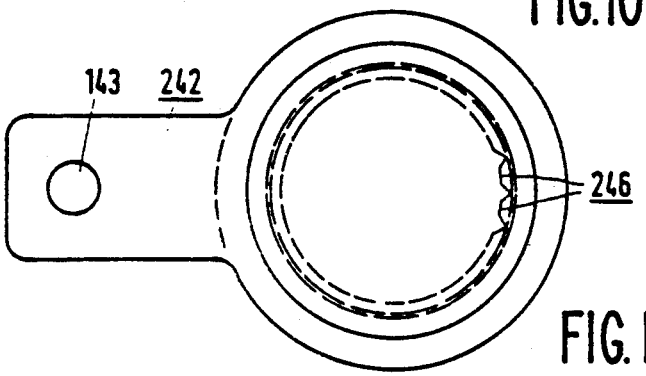

Here the mounting member 240 comprises a first part 241 (FIGS. 10*b* and *c*) and a second part 242 (FIGS. 10*d* and *e*). The first part 241 is passed into the second part 242 according to the arrow Xe in FIG. 10*d*, with a collar 243 against a stop 244. The first part keeps the second part fixed owing to the coupling to the contact pins, by which the first part is rigidly connected to the insulator body 130. Cooperating means, consisting of projections 245 and a ribbed rim 246, give the two parts a comparatively strong resistance to rotation at a number of rotational positions. The projections 245 are positioned in a resilient manner on bent tongues 249. Hooks 247 at these tongues grip behind a rim 248, which facilitates handling of the mounting member during assembly with the unit. When the second part 242 is rigidly connected to the surroundings, the first part 241 can be rotated along with the rest of the lamp in order to bring the lamp vessel 1 into the desired position during assembly of the lamp.

We claim:

1. A capped electric lamp for operation at mains voltage, comprising:

a lamp vessel which is vacuum sealed and has an end portion (2) which is fused to a stem (3) which projects into the lamp vessel and surrounds an exhaust tube (4);

an electric element in the lamp vessel connected to at least two current supply conductors (6) which extend from the lamp vessel alongside the exhaust tube;

a lamp cap (10) comprising a shell (20) and an insulator body (30), the shell having an axis (21), a first end (22) of the shell being fixed around said end portion (2) of the lamp vessel with an adhesive compound, a second end (23) of the shell being secured to the insulator body (30);

at least two contact pins (31) fixed in the insulator body and extending to the exterior therefrom;

the current supply conductors (6) being respectively connected to the respective contact pins (31) where said contact pins extend from the insulator body (30); and a mounting member (40) of synthetic resin, said mounting member being secured to the insulator body (30), only the contact pins (31) projecting through said mounting member to the exterior.

2. A capped electric lamp as claimed in claim 1, characterized in that the mounting member (40) has projecting sheaths (41) through which the contact pins (31) respectively extend to the exterior.

3. A capped electric lamp as claimed in claim 1 or 2, characterized in that the contact pins each have a widened portion (33) which butts against a surface (42) of the mounting member (40) which faces towards the insulator body (30).

4. A capped electric lamp as claimed in claim 1 or 2, characterized in that the mounting member (50, 60) comprises resilient tongues (54, 64) curved in a hairpin shape, which tongues each have a free end with a wedge-shaped thicker portion (55, 65) and extend alongside the axis (21) of the shell (20) to beyond a location where they project from the mounting member (50, 60).

5. A capped electric lamp as claimed in claim 1 or 2, characterized in that the mounting member (40, 50, 60) has an upright rim (46, 56, 66) in which the insulator body (30) is accommodated.

6. A capped electric lamp as claimed in claim 1 or 2, characterized in that the insulator body (30) has for each of the current supply conductors (6) a narrowing channel (34) which issues near a corresponding contact pin (31) at the location where the latter projects from the insulator body (30) to the exterior.

7. A capped electric lamp as claimed in claim 6, characterized in that the current supply conductors (6) are respectively laterally fastened against the respective contact pins (31).

8. A capped electric lamp as claimed in claim 6, characterized in that the adhesive compound (11), the insulator body (30), and the mounting member (40) fully separate the current supply conductors (6) from one another starting from the end portion (2) of the lamp vessel (1).

9. A capped electric lamp as claimed in claim 1 or 2, characterized in that the insulator body (30) is made of synthetic resin and the shell (20) is a metal ring and has at its second end (23) an inwardly flanged rim (24) which cooperates with a collar (35) of the insulator body.

10. A capped electric lamp as claimed in claim 1 or 2, characterized in that the contact pins (31) each have a recess (313) and the mounting member (140) has resiliently provided projections (147) which grip into corresponding recesses (313), thereby fixedly coupling the mounting member (140) to the insulator body (130).

11. A capped electric lamp as claimed in claim 10, characterized in that the mounting member (140) comprises a first part (241) and a second part (242), the first part being rigidly connected to the insulator body (13) and rotatably coupled to the second part.

12. A capped electric lamp as claimed in claim 11, characterized in that the first (141) and the second (142) part of the mounting member (140) have cooperating means (245, 246) which provide fixation against rotation in several rotational positions.

13. A lamp cap unit for use as an element of a capped electric lamp having a vacuum sealed vessel with an end portion (2) which is fused to a stem (3) which projects into the lamp vessel and surrounds an exhaust tube (4), the lamp vessel having an electric element therein connected to at least two current supply conductors (6) which extend from the lamp vessel alongside said exhaust tube; said lamp cap unit comprising:

a shell (20) having an axis (21), a first end (22) of said shell being affixed around said end portion (2) of the lamp vessel with an adhesive compound;

an insulator body (30) coupled to a second end (23) of said shell, said current supply conductors extending through said shell and said insulator body and projecting from said insulator body; and at least two contact pins fixed in said insulator body and extending to the exterior therefrom, said contact pins being respectively connected to the respective current supply conductors where said conductors project from said insulator body.

14. A lamp cap unit as claimed in claim 13, characterized in that the insulator body (30) has for each of the current supply conductors (6) a narrowing channel (34) which issues near a corresponding contact pin (31) where the latter projects from said insulator body.

15. A lamp cap unit as claimed in claim 14, characterized in that the respective current supply conductors (6) are laterally fastened against the respective contact pins (31).

16. A unit as claimed in claim 15, characterized in that the adhesive compound (11) and the insulator body (30) fully separate the current supply conductors (6) from one another starting from the end portion (2) of the lamp vessel (1).

17. A unit as claimed in claim 1, characterized in that the insulator body (30) is made of synthetic resin and the shell (20) is a metal ring having at said second end (23) thereof an inwardly flanged rim (24) which cooperates with a collar (35) on the insulator body (30).

* * * * *